United States Patent [19]

Schnetzer et al.

[11] 4,008,560

[45] Feb. 22, 1977

[54] THREADING DEVICE FOR A FALSE-TWIST TEXTURING MACHINE WITHOUT UPPER STRUCTURE

[75] Inventors: Max Schnetzer; Risto Merimaki, both of Wattwil, Switzerland

[73] Assignee: Heberlein Maschinenfabrik AG, Wattwil, Switzerland

[22] Filed: Feb. 23, 1976

[21] Appl. No.: 660,279

[30] Foreign Application Priority Data

Mar. 7, 1975 Switzerland ..... 2893/75
Jan. 14, 1976 Switzerland ..... 362/76

[52] U.S. Cl. ..... 57/34 HS; 57/106
[51] Int. Cl.[2] ..... D02G 1/02
[58] Field of Search ..... 57/34 HS, 157 TS, 34 R, 57/106; 28/1.2, 62

[56] References Cited

UNITED STATES PATENTS

| | | | |
|---|---|---|---|
| 3,015,872 | 1/1962 | Jones | 57/34 HS X |
| 3,448,572 | 6/1969 | Meronen | 57/106 |
| 3,527,043 | 9/1970 | Sabaton | 57/34 HS |
| 3,559,255 | 2/1971 | Cockroft | 28/62 |
| 3,636,697 | 1/1972 | Treptow et al. | 57/106 |
| 3,747,227 | 7/1973 | Zang et al. | 57/34 HS X |
| 3,842,578 | 10/1974 | Schippers | 57/34 HS |

FOREIGN PATENTS OR APPLICATIONS

| | | | |
|---|---|---|---|
| 546,015 | 7/1956 | Italy | 57/34 HS |

*Primary Examiner*—John Petrakes
*Attorney, Agent, or Firm*—Larson, Taylor and Hinds

[57] ABSTRACT

A false-twist texturing machine of reduced height having along one side a series of vertical contact heating devices for yarns and on the other, or service side, wind-up devices for the treated yarn, is provided for each heating device with an individual thread guide channel enabling an operator to thread the heating device while he remains on the service side of the machine. The channel is tubular with a slot along its length. The operator attaches a weight to a thread emerging from a delivery device and puts it into an upper end of the channel inclined downwards above upper thread guide means to a vertical portion of the channel extending downwards past the remote side of the heating device to an inclined portion of the channel extending beneath further thread guide means to a point at which the weight emerges and is detached by the operator, who then threads it through a false-twist imparter and a delivery device on the service side to a wind-up device. Tension on the yarn causes it to emerge from the slot in the channel and make contact with the guide means and heating device. The vertical portion of the channel is hinged at one edge to the heating devices. Alternatively, the vertical portion of the channel may be mounted a little away from the heating device with intervening substantially parallel walls extending from the slot nearly to the heating device and between which the yarn passes from the channel to make contact with the heating device.

7 Claims, 4 Drawing Figures

THREADING DEVICE FOR A FALSE-TWIST TEXTURING MACHINE WITHOUT UPPER STRUCTURE

FIELD OF THE INVENTION

The present invention relates to threading devices for false-twist texturing machines.

In false-twist texturing machines, a temporary high twist is imparted to a yarn of synthetic thermoplastic material which is heat-set before being eliminated again. For the heat transfer, contact heating devices have proved particularly advantageous.

DESCRIPTION OF THE PRIOR ART

In the known false-twist texturing machines, the heating devices, as a rule, are disposed at body level in relation to the operators. Depending on whether the yarn moves upwards or downwards, the yarn delivery bobbins or the wind-up devices lie below the vertically disposed heating devices. If the yarn movement speeds are high and long heating devices are therefore necessary, these machines are relatively high and need much vertical space.

In order to reduce the height of false-twist texturing machine by eliminating the upper part, i.e. so that the machine extends only through one storey of the building in which it is placed, which all the same provides enough space for a sufficient length of the heating devices, an arrangement has proved advantageous in which the vertical heating devices distributed along the whole length of the machine are placed on one side of the machine, and the wind-up devices extending along the length of the machine at different levels on the other side of the machine.

In this construction, however, threading of the yarns to be treated is difficult since the service side is naturally the front side with the wind-up devices. The operators would therefore have to go to the other side of the machine for threading the yarns in the heating devices whereby, however, time would be lost unnecessarily.

SUMMARY OF THE INVENTION

It is the purpose of the present invention to provide a threading device for a false-twist texturing machine of reduced height having a contact heating device, by which the yarn can be threaded rapidly and without difficulties in the heating device which is not immediately accessible to the operators.

According to the present invention, this problem is resolved by a channel for a weight to be fixed on the yarn to be threaded, the central portion of which channel extends along the contact heating device and the terminal portions of which lead from the upper and lower ends of the heating device to the operator side of the machine, the channel having on its whole length a longitudinal slot which permits the threaded yarn to escape laterally from the channel into contact with the heating device and with thread-guide members disposed ahead of and beyond the heating device. The cross-section of the channel is preferably circular, but it is also possible to use a channel of polygonal cross-section.

The device of the present invention enables yarns to be threaded in an efficient manner and is fool-proof. It has decisive advantages with respect to possible alternatives. In comparison with threading by air under pressure which would have to be effected in a closed tube, the invention has the advantage that a channel with a longitudinal slot can be used from which the yarn can be removed easily after threading and applied against the thread-guide members and the contact heating plate. It is also possible to use a slider on a rail, but the radius of the rail would have to be relatively big to assure safe movement of the slider which is moreover not possible for space reasons because of the compact construction of the machine. The possibility of threading by pulling the yarn by a flexible element extending along the yarn path is complicated to operate and accordingly requires too much time.

The formation of deposits of sizing agents due to the condensation of vapours thereof during the passage of the yarns through the heating device may necessitate fairly frequent cleaning of the heating device.

In a further development of the threading device, therefore, cleaning is facilitated in that the portion of the threading channel that extends along the heating device is disposed at a distance from the heating device and in that two walls contiguous with the edges of the longitudinal slot and extending in parallel with each other at a distance from each other corresponding to the width of the slot, extend over the whole length of the contact heating device and have a width which at least approximately corresponds to the distance between the channel portion and the contact heating device.

DESCRIPTION OF THE DRAWINGS

Examples of the present invention will be described hereinafter with reference to the accompanying drawings wherein:

Referring to FIG. 1, the portion of the false-twist texturing machine shown therein includes a yarn input delivery device 1, that receives yarn from a bobbin in a rack (not shown), a forked thread-guide 2, a pulley device 3, a vertically extending contact heating device 4, a second pulley device 5, a guide element 6 that changes the course of the yarn, a false-twist imparter 7, an output delivery device 8 and a wind-up device 9. The heating device 4 comprises a channel 10 (FIG. 3) extending in the direction of yarn movement and in which a bent contact heating plate 11 having a groove 12 for guiding the yarn is arranged. Each of the pulley devices 3 and 5 consists of a lever 15 or 16 one end of which is pivotable on a shaft 13 or 14 and the other end of which carries a forked part 26 or 27 which carries a pulley 19 or 20 (FIG. 2).

Figure 3:
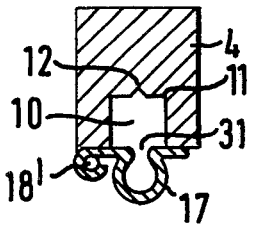
FIG. 3 is a cross-section along line B—B of FIG. 1 on an enlarged scale.

The threading channel consists of a central portion 17 extending along the heating device 4 which has a cross-section in the form of the Greek letter omega, as shown in FIG. 3. The portion 17 is arranged on the open side of the channel 10 of the heating device 4, and presents a longitudinal slot 31 towards the center of the channel. One longitudinal edge of portion 17 which is made of sheet metal is rolled over so that it forms a tubular socket into opposite ends of which hinge pins 18, 18' project, the pins being fixed on support plates 21, 21'. By means of these hinges, the central portion 17 can be swung away from the heating device so that the channel 10 is made accessible.

Between the central portion 17 and the delivery device 1 on the one hand and between the central portion 17 and the yarn deviation element 6 on the other hand are disposed two terminal portions 22, 23 of the threading channel each of which consists of a tube having a longitudinal slot corresponding to the slot 31. The terminal portions 22, 23 are connected with the corresponding extremities of the central portion 17 by means of bent tubular portions 24, 25 having longitudinal slots connecting the slots in the portions 22, 23 to the slot 31.

The threading of yarn through the assembly from the delivery device 1 to the wind-up device 9 is effected as follows:

First a weight 29, preferably in the form of a sphere or of an ellipsoidal object, is fixed on the yarn 30 and thereafter inserted into the terminal portion 22 of the threading channel whereupon it slides through the whole channel together with the yarn (indicated by a broken line) and reaches a receiving element 28 made of sheet iron after having passed through the terminal portion 23. The operator then takes hold of the yarn 30 and pulls it so that it leaves the whole threading channel through the longitudinal slots and is drawn into the forked thread-guide 2, the pulleys 19, 20 and the contact heating plate 11. The yarn 30 is then, after removal of the weight 29, led around the element 6, inserted into the twist imparter 7 and the yarn delivery device 8 and fed to the wind-up device 9. The yarn then extends along the full lines marked with arrows.

Figure 1:
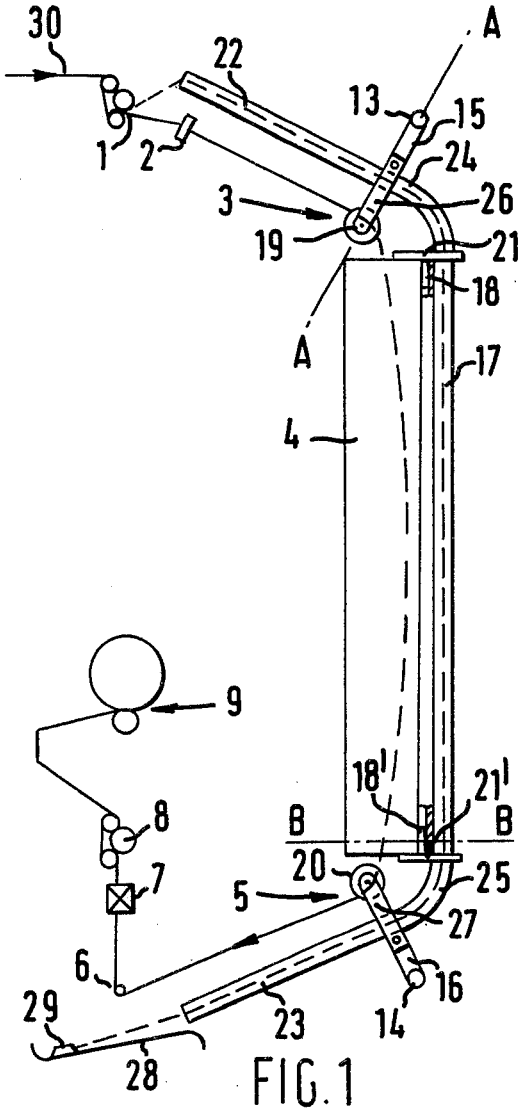
FIG. 1 is a lateral elevation of part of a processing position in a false-twist texturing machine.
Figure 2:
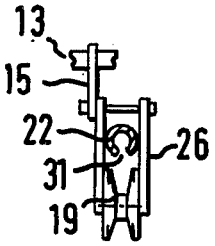
FIG. 2 is a cross-section along line A—A of FIG. 1 on an enlarged scale.
Figure 4:
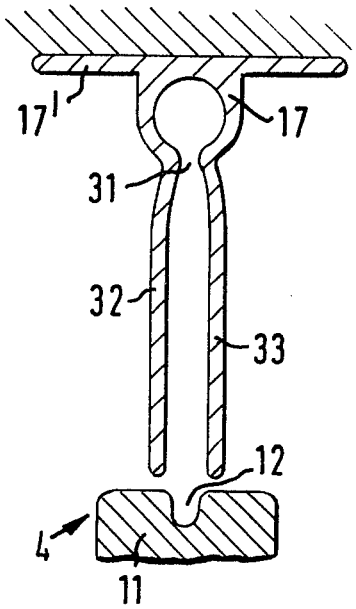
FIG. 4 is a cross-section on an enlarged scale showing a modification of the detail shown in FIG. 3.

In the modification of FIG. 4 (wherein the reference numerals of FIGS. 1 to 3 are repeated for similar parts) the central portion 17 of the threading channel, which extends along the heating device 4, is of tubular shape and comprises, on the side facing the contact heating plate 11, a longitudinal slot 31. On the opposite side of the central portion 17, there is a support plate 17'. The central portion 17 is situated at a distance of approximately 5 cm from the contact heating plate 11 and is fixed on a part of the device (not shown) by means of an extension of the support plate 17'. The edges of the longitudinal slot 31 merge into two walls 32, 33, extending in parallel with each other along the whole length of the heating device at a distance from each other substantially corresponding to the width of the slot, and into immediate proximity of the contact heating plate 11 whereby safe application of the yarn into groove 12 is assured. This arrangement renders the groove 12 easily accessible so that it can be cleaned without difficulty.

Referring again to FIG. 1 it will be seen that an operator is able to thread the assembly while he is on the service side of the machine, that is on the side on which the wind-up devices 9 extend along the length of the machine.

While the channel 17 is shown in the drawings as having a cross-section in the shape of a circular arc, it may alternatively have a basically polygonal cross-section.

We claim:

1. In a false-twist texturing machine having an assembly comprising a vertically extending contact heating device for yarn travelling downwards therealong, a yarn input delivery device and first thread-guide means for delivering yarn to the upper end of said heating device, a yarn output delivery device, second thread-guide means and a false-twist imparter arranged for yarn from the lower end of said heating device to pass therethrough to said output delivery device and a wind-up device for winding up yarn received from said output delivery device, said heating device being on one side of the machine and said wind-up device on the opposite side of the machine; a threading device for said assembly comprising a channel guide extending along one side of said heating device from a location above said heating device to a second location beneath said heating device, said channel guide being shaped as a guide for a weight attached to one end of yarn extending from said input delivery device and falling under gravity therethrough to said second location, and said channel guide having its open side constituted by a slot presented towards said heating device and towards said first and second thread-guide means whereby the yarn can pass into contact with said heating device and said first and second thread-guide means after being drawn through said channel guide by the weight.

2. In the false-twist texturing machine according to claim 1, said channel guide comprising a vertical channel portion extending along said heating device on the side thereof remote from said wind-up device, an upper inclined terminal portion extending above said first thread guide means towards said opposite side of the machine, a lower inclined terminal portion extending beneath said second thread guide means towards said opposite side of said machine, and curved connecting portions connecting the upper and lower ends of said vertical channel portion respectively to adjacent ends of said upper and lower terminal portions.

3. In the false-twist texturing machine according to claim 2, hinge means interposed between one edge of said vertical channel portion and said heating device whereby said channel portion can be turned away from said heating device on said hinge means.

4. In a false-twist texturing machine according to claim 2, said vertical channel portion being formed from sheet metal so as to present along its length in the vertical direction a cross-section in the shape of the Greek letter omega, one edge of said channel portion being rolled over to provide a tubular socket, and said threading device including also two hinge pins fixed to said heating device and projecting respectively into opposite ends of said socket.

5. In a false-twist texturing machine according to claim 1, said channel guide being essentially a tube of circular cross-section formed alone its length with a slot.

6. In a false-twist texturing machine according to claim 1, said heating device being formed with a vertical channel and including a heating plate mounted in said vertical channel, said channel guide being mounted with its open side presented towards one open side of said vertical channel in said heating device.

7. In a false-twist texturing machine according to claim 1, said channel guide being essentially a tube formed with a longitudinal slot and being mounted to extend along said heating device with a space therebetween, and said threading device further including two walls extending in parallel along the whole length of said contact heating device at a distance from each other corresponding to the width of said slot, said walls extending at least approximately from the edges of said slot to said heating device.

* * * * *